US008109447B2

(12) United States Patent
Savill, Jr. et al.

(10) Patent No.: US 8,109,447 B2
(45) Date of Patent: Feb. 7, 2012

(54) INTRINSICALLY SAFE VALVE FOR A COMBUSTION SPRAY GUN AND A METHOD OF OPERATION

(75) Inventors: Robert F. Savill, Jr., Westbury, NY (US); Mark F. Spaulding, Northport, NY (US); James K. Weber, Bay Shore, NY (US); Richard A Zapke, Merrick, NY (US)

(73) Assignee: Sulzer Metco (US) Inc., Westbury, NY (US)

( * ) Notice: Subject to any disclaimer, the term of this patent is extended or adjusted under 35 U.S.C. 154(b) by 264 days.

(21) Appl. No.: 12/428,107

(22) Filed: Apr. 22, 2009

(65) Prior Publication Data

US 2010/0270387 A1 Oct. 28, 2010

(51) Int. Cl.
*B05B 17/00* (2006.01)
*F23D 11/32* (2006.01)

(52) U.S. Cl. ..... 239/1; 239/526; 239/394; 239/83; 239/691

(58) Field of Classification Search ..... 239/83–85, 239/691, 526, 394, 437, 442, 1
See application file for complete search history.

(56) References Cited

U.S. PATENT DOCUMENTS

| | | | | |
|---|---|---|---|---|
| 2,092,150 | A | 9/1937 | Bleakley | |
| 4,286,755 | A * | 9/1981 | Shipman | 239/530 |
| 4,317,540 | A | 3/1982 | Simm et al. | |
| 4,619,403 | A * | 10/1986 | Goldney et al. | 239/456 |
| 4,676,437 | A * | 6/1987 | Brown | 239/414 |
| 4,915,304 | A * | 4/1990 | Campani | 239/473 |
| 5,282,573 | A | 2/1994 | Reimer | |
| 5,297,733 | A | 3/1994 | Burks et al. | |
| 5,544,811 | A | 8/1996 | Tillery et al. | |
| 5,662,273 | A * | 9/1997 | Chih | 239/526 |
| 5,667,142 | A * | 9/1997 | Newman | 239/346 |
| 5,932,293 | A | 8/1999 | Belashchenko et al. | |
| 6,431,468 | B1 | 8/2002 | Brown et al. | |
| 2005/0258274 | A1 * | 11/2005 | Wang | 239/393 |
| 2007/0095944 | A1 * | 5/2007 | Chih | 239/394 |

FOREIGN PATENT DOCUMENTS

FR 2816524 5/2002

OTHER PUBLICATIONS

Inactive JTEG Project Summaries, Project No. 57580, Thermoplastic Powder Coating, Test and Evaluation Date of Mar. 1996 (date of publication uncertain), pp. 1-15, http://www.jdmag.wpafb.af.mil/inactproj24.htm.

Praxair Surface Technologies, Inc., Model BP400 Arc Spray System, Revision A, Apr. 1, 1998, pp. 1-4, http://www.innovator.com.tw/prodown/Bp400.pdf.

EP Search Report/Written Opinion of Jun. 9, 2010.

* cited by examiner

*Primary Examiner* — Dinh Nguyen
*Assistant Examiner* — Jennifer Gordon
(74) *Attorney, Agent, or Firm* — Greenblum & Bernstein, P.L.C.

(57) ABSTRACT

A valve for a combustion spray gun. An apparatus includes a torsion element rotatable relative to a housing of the combustion spray gun to a charged position. The apparatus also includes a biasing element applying a force to the torsion element, which force urges the torsion element to move a valve core to an off position. The apparatus further includes an engagement mechanism configured to selectively engage and hold the torsion element in the charged position.

11 Claims, 13 Drawing Sheets

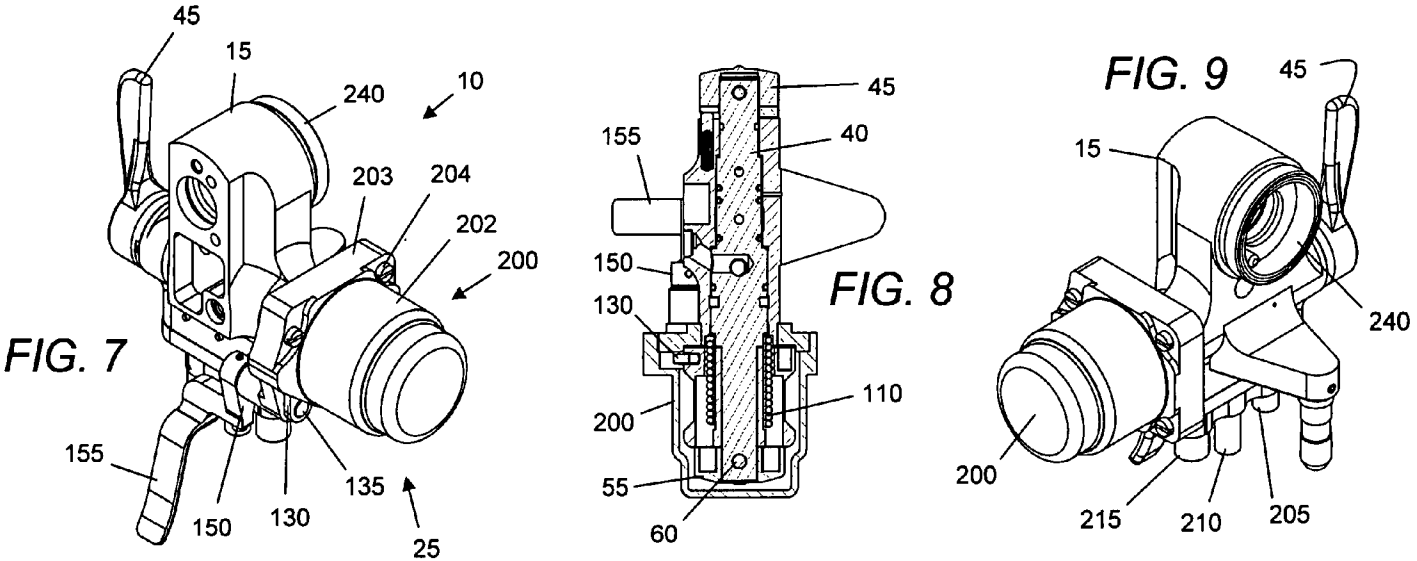
10
15
45
240
203
204
202
200
25
135
130
150
155
FIG. 7
155
150
130
200
55
60
110
40
45
FIG. 8
15
45
240
205
210
215
200
FIG. 9
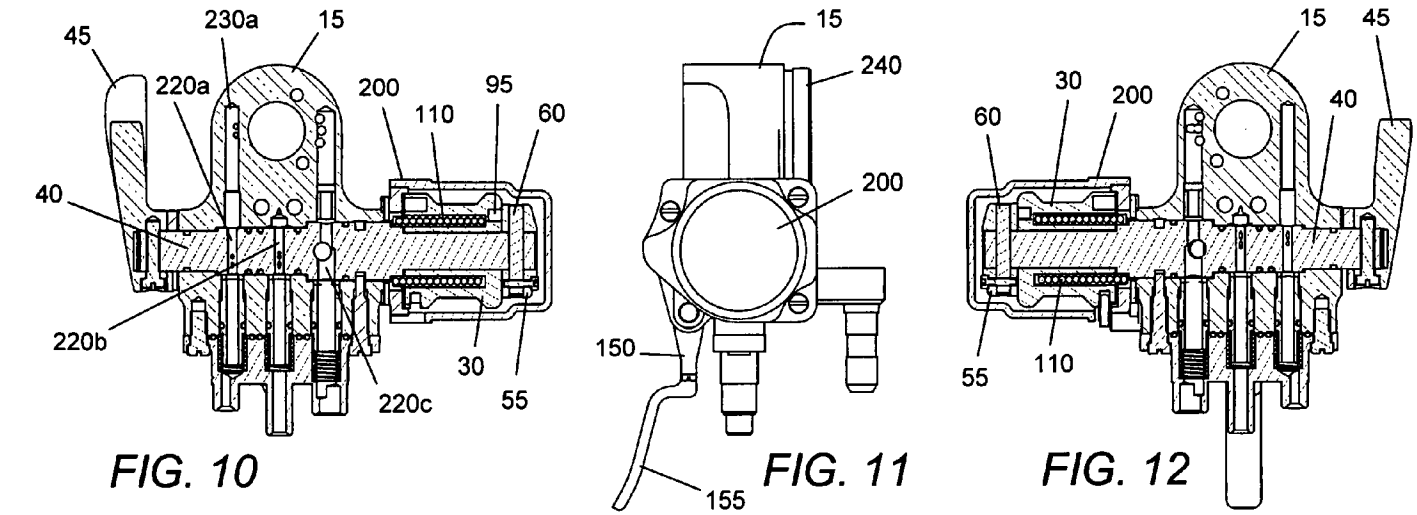
15
45
230a
220a
200
95
110
60
40
220b
220c
30
55
FIG. 10
15
240
200
150
155
FIG. 11
15
45
40
200
30
60
110
55
FIG. 12

INTRINSICALLY SAFE VALVE FOR A COMBUSTION SPRAY GUN AND A METHOD OF OPERATION

BACKGROUND OF THE INVENTION

1. Field of the Invention

The invention relates generally to systems and methods for applying coatings, and more specifically to an intrinsically safe, multi-ported valve for controlling a hand-held combustion spray gun.

2. Discussion of Background Information

Combustion wire spray systems and processes are known for providing coatings on objects for various purposes. A typical combustion wire spray system includes a hand-held combustion spray gun that mixes oxygen, fuel gas, and air to melt a metal wire and spray the molten metal as a coating onto a target object. For example, a conventional combustion spray gun has a set of drive rolls powered by an air turbine that draw one or more metal wires into the gun. Oxygen and fuel gas are mixed in the gun and ignited to create a flame. Common fuel gases include acetylene, hydrogen, propane, methylacetylene-propadiene, or natural gas. Compressed air is used to shape and accelerate the flame at an air cap which includes an outlet nozzle. The metal wire is fed into the flame where it is melted and atomized. In this manner, molten droplets of the metal are propelled toward the object to be coated.

The sprayed-on molten metal solidifies on the object to form a coating that provides the surface of the object with one or more performance-enhancing characteristics. For example, combustion wire spray coating may be used for many applications, including but not limited to: corrosion protection, wear protection, surface restoration, electrical/thermal conductivity, decorative surfaces, etc.

Conventional air-powered combustion spray guns typically have a valve core for controlling the flow of various gasses, e.g., oxygen, fuel gas, and compressed air, through the gun. The valve core can be a rotary element that has various ports and passageways that, depending on the rotational position of the valve core, selectively control flow of the different gasses within the gun. For example, the valve core may be ported such that a plurality of gasses can be controlled simultaneously to achieve controlled flows for off, idle/ignite, and full flow operating conditions. Particularly, by rotating the valve core to a predefined position, ports within the valve core line up with gas passages in other parts of the gun. The diameters of the various ports in the valve core dictate the flow of each gas by acting as a flow-regulating orifice depending upon the supply pressure of each gas.

Typically, the position of the valve core is set by the operator using a valve core handle that extends from the combustion spray gun. When the operator rotates the valve core handle to a predetermined position corresponding to an operating condition, e.g., off, idle/ignite, full flow, etc., the valve core is positioned within the gun to provide a precise mixture of gasses for that operating condition. Generally, a spring-loaded detent mechanism maintains the valve core in each predetermined position. In this manner, the operator can set the operating condition of the gun using the valve core handle, and then release the valve core handle and use both hands for controlling the motion of the gun. Because the valve core stays in position once set, the gun will continue to emit a high velocity flame and molten metal until the operator turns the valve core handle to the off position. This can present a safety hazard, for example, in the case of a dropped gun that is operating at full flow.

Conventional air-powered combustion spray guns, such as those described above, do not have a mechanism for automatically stopping gun operation in case of an operator accident. Many electrically powered devices, from robots to hand-held power tools, have a safety "deadman" switch that cuts off electrical power to the device or tool when the switch is released by an operator. However, since hand-held air-powered combustion spray guns do not utilize electrical power, electrical deadman switches are not applicable to such combustion spray guns.

Moreover, known electrical emergency cutoff devices only provide for an on and off position. Hand-held air-powered combustion guns, on the other hand, require multiple position settings for different gas flow states. Additionally, since hand-held air-powered combustions guns should be lightweight to minimize operator fatigue, adding extra safety valves to an existing gun is not desirable.

Accordingly, there exists a need in the art to overcome the above-noted deficiencies.

SUMMARY OF THE INVENTION

Exemplary embodiments and advantages of the present invention may be ascertained by reviewing the present disclosure and the accompanying drawings. In accordance with a first aspect of the invention, there is an apparatus configured to provide a safety mechanism for a combustion spray gun. The apparatus includes a torsion element rotatable relative to a housing of the combustion spray gun to a charged position. The apparatus also includes a biasing element applying a force to the torsion element, which force urges the torsion element to move a valve core to an off position. The apparatus further includes an engagement mechanism configured to selectively engage and hold the torsion element in the charged position.

In an embodiment, the engagement mechanism holds the torsion element in the charged position when at least a predetermined force is applied to the engagement mechanism, whereas the engagement mechanism disengages from the torsion element when less than the predetermined force is applied to the engagement mechanism. Also, the valve core may be rotatable relative to the torsion element and the housing while the torsion element is held in the charged position by the engagement mechanism.

In a particular implementation, the torsion element has an engagement surface, and the engagement mechanism has a pawl that is structured and arranged to engage the engagement surface. The engagement surface may be formed in an indentation at an outer portion of the torsion element. The apparatus may additionally include a trigger fixedly connected to the pawl, wherein the trigger is structured to move the pawl relative to the torsion element. Application of a trigger force to the trigger that is greater than or equal to a predetermined force maintains the pawl in engagement with the engagement surface and prevents the biasing element from rotating the torsion element.

The biasing element may be a spring that biases the torsion element to rotate relative to the housing. Also, the combustion spray gun may be a hand-held, air powered combustion spray gun.

In accordance with another aspect of the invention, there is a combustion spray gun having a gas head assembly including a housing and a valve core rotatably disposed within the housing. The valve core is selectively positionable between an off position and a full flow position. The gun also includes a biasing element positionable to bias the valve core toward the off position, and an engagement mechanism configured to selectively counteract a biasing force associated with the biasing element.

In an embodiment, the gun additionally has a handle and a trigger moveable relative to the handle. The engagement mechanism counteracts the biasing force when at least a predetermined force is applied to the trigger, whereas the biasing force is transmitted to the valve core when less than the predetermined force is applied to the trigger.

In another embodiment, the gun includes a torsion element rotatably connected to the housing. The torsion element selectively transmits the biasing force to the valve core. In a further embodiment, the engagement mechanism counteracts the biasing force by engaging the torsion element in a charged position and holding the torsion element in the charged position. In an even further embodiment, the engagement mechanism holds the torsion element in the charged position when at least a predetermined force is applied to a trigger of the engagement mechanism, and the engagement mechanism disengages from the torsion element when less than the predetermined force is applied to the trigger of the engagement mechanism. The valve core may be rotatable relative to the torsion element and the housing while the torsion element is held in the charged position by the engagement mechanism.

In accordance with another aspect of the invention, there is a method of operating a combustion spray gun. The method includes charging a torsion element into a charged position and releasably grasping a trigger to selectively maintain the torsion element in the charged position. The method also includes adjusting a gas flow to a nozzle while the torsion element is selectively maintained in the charged position and cutting the gas flow to the nozzle when the trigger is released.

In an embodiment, the charging of the torsion element includes rotating a valve core from an off position to a flow position against a force of a biasing element, and the cutting of the gas flow comprises the torsion element moving the valve core to an off position under the force of the biasing element.

The method may additionally include igniting the gas flow and feeding a metal wire into the ignited gas flow. In a particular embodiment, the releasably grasping of the trigger inserts a pawl into a notch formed in the torsion element.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIGS. 1-3, 4A-4F, 5A-5F, 6A-6F, and 7-12 show aspects of a safety mechanism for use with a combustion spray gun in accordance with aspects of the invention;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention relates generally to systems and methods for applying coatings, and more specifically to an intrinsically safe, multi-ported valve for controlling a hand-held combustion spray gun. In accordance with aspects of the invention, a safety mechanism is provided for a hand-held, air-powered combustion spray gun. In an embodiment, the safety mechanism operates as a deadman switch that automatically halts operation of the combustion spray gun in the event that the operator releases a trigger.

In a particular embodiment, the safety mechanism includes a torsion ring that is urged by a biasing element to move the valve core to the off position. The torsion ring may be rotated by the operator to a charged position and held in the charged position by application of force to a trigger located near the handle of the combustion spray gun. While the torsion ring is held in the charged position, the operator is free to rotate the valve core to any desired operational position, including, for example, full flow, idle/ignite, and off. However, when the operator releases the trigger, the biasing element automatically shuts off the flow of oxygen and fuel gas by rotating the valve core to the off position. In this manner, implementations of the invention provide a deadman switch for a hand-held, air-powered combustion spray gun.

Embodiments of the invention are described herein with respect to a hand-held combustion wire spray gun. However, the invention is not limited to use with a combustion wire spray gun. Thus, implementations of the invention may be utilized with any hand-held, gas-powered device in which the rotational position of a rotary valve controls operation of the device, including but not limited to: combustion powder spray guns, high velocity oxygen fuel (HVOF) spray systems, welding systems, etc.

Figure 1:
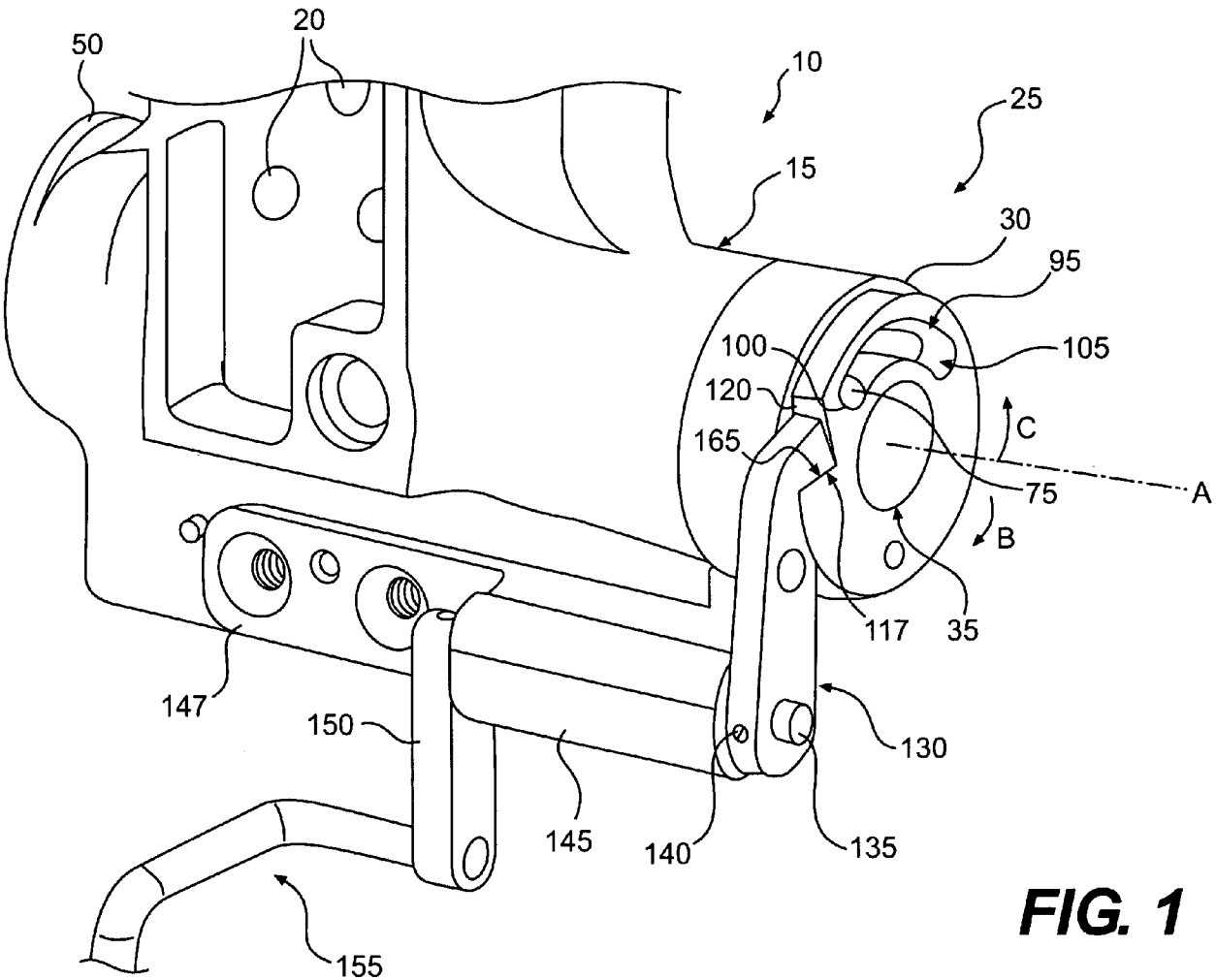

FIG. 1 shows a cutaway view of an embodiment of a gas head assembly 10 of a combustion spray gun in accordance with aspects of the invention. More specifically, the gas head assembly 10 includes a housing 15 having various ports and passageways 20 for routing oxygen, fuel gas, and compressed air through the combustion spray gun. The gas head assembly 10 also includes a safety mechanism 25 for automatically shutting off the flow of gasses through the combustion spray gun under certain circumstances.

Figure 2:
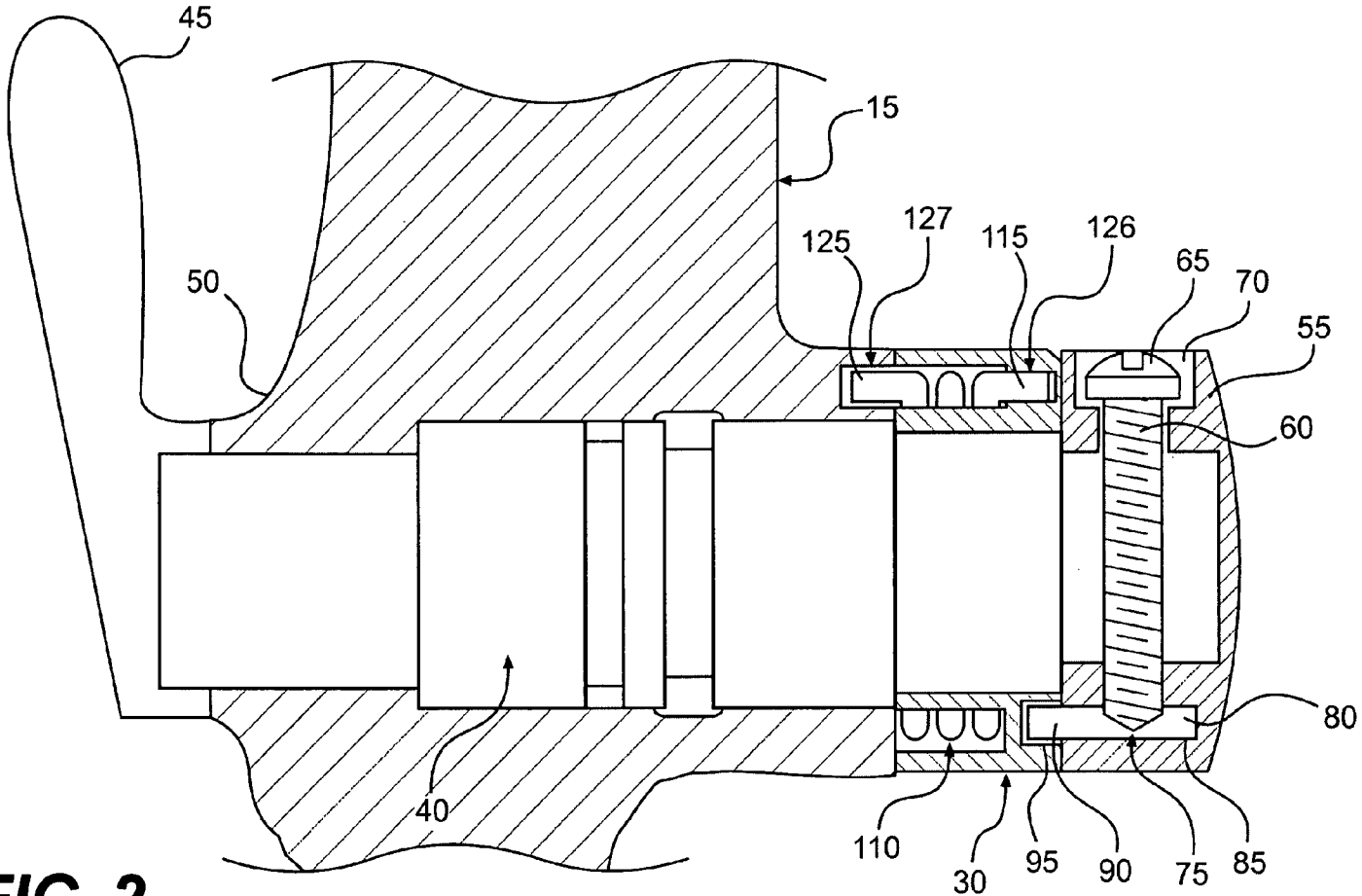

In an embodiment, the safety mechanism 25 includes a torsion ring 30 that is rotatably aligned with a valve core 40 and rotatable relative to the housing 15 about axis "A". With reference to FIGS. 1 and 2, the torsion ring 30 has a hole 35 that accommodates a valve core 40. The valve core 40 is rotatable relative to both the housing 15 and the torsion ring 30 about axis "A". Although not depicted in FIGS. 1 and 2, the valve core 40 includes suitable ports for precisely controlling the flow of gasses within the gas head assembly 10 of the combustion spray gun. For example, as is known such that further explanation is not believed necessary, ports may be provided in the valve core 40 and housing 15 to define flow conditions for oxygen, fuel gas, and compressed air for at least three operating conditions including, but not limited to, off, idle/ignite, and full flow conditions.

As depicted in FIG. 2, a valve core handle 45 is connected to the valve core 40. The valve core handle 45 permits an operator to selectively set the rotational position of the valve core 40. Although the valve core handle is shown at an end 50 of the housing 15 opposite the torsion ring 30, the invention is not limited to this configuration. Rather, the valve core handle 45 and torsion ring 30 may be located in any desired locations relative to the housing 15. For example, the valve core handle can be located at any circumferential position around the torsion ring 30, including on a same side of the housing 15 as the torsion ring 30.

In a particular embodiment, an end cap 55 is fixedly connected to the valve core 40, such that the valve core 40, valve core handle 45, and end cap 55 rotate together as a single unit. The end cap 55 may be affixed to the valve core 40 using a screw 60 having a head 65 that is countersunk into a cavity 70 of the end cap 55. However, the invention is not limited to this configuration, and other connecting arrangements, including press/friction fit, splines, adhesive, etc., may be used to affix the end cap 55 to the valve core 40.

Still referring to FIG. 2, a pin 75 has a first end 80 fixedly held in a hole 85 in the end cap 55. A second end 90 of the pin 75 is slidingly received in a slot 95 in the torsion ring 30. As depicted in FIG. 1, the slot 95 has an arcuate shape having a first slot end 100 and a second slot end 105. By virtue of the first end 80 of the pin 75 being fixed to the valve core 40 via the end cap 55 and the second end 90 of the pin 75 being slidably engaged in the slot 95, the slot 95 defines a range of relative rotational movement that can occur between the valve core 40 and the torsion ring 30.

In one implementation, the safety mechanism 25 further includes a biasing element 110 that biases the torsion ring 30 to rotate relative to the housing 15 in a first direction, e.g., clockwise as depicted by arrow "B". In a particular embodiment, the biasing element 110 is composed of a torsion spring having a first spring end 115 engaged in a first anchor hole 126 in the torsion ring 30 and a second spring end 125 engaged in a second anchor hole 127 in the housing 15. The biasing element 110 can be any desired type of spring suitable to urge relative rotational movement between the torsion ring 30 and the housing 15. Preferably, the biasing element 110 is a constant force torsion spring. However, the invention is not limited to a constant force torsion spring, but rather, any suitable spring, including but not limited to a plain torsion spring, round spring, etc., can be used.

Due to the interaction between the slot 95 and the pin 75, the biasing element 110 also biases the valve core 40 to rotate relative to the housing 15 in the first direction "B" under certain conditions. More specifically, when the biasing element 110 causes the torsion ring 30 to rotate relative to the housing 15 in the first direction "B", the first slot end 100 abuts and pushes against the pin 75, which causes the valve core 40 to rotate with the torsion ring 30 relative to the housing 15 in the first direction "B". At least one of the valve core 40 and the housing 15 may be provided with a mechanical stop (not shown) that prevents rotation of the valve core 40 in the first direction "B" beyond a predetermined position. In a preferred embodiment, the predetermined position corresponds to the off operating positioning of the combustion spray gun, e.g., where oxygen and fuel gas are prevented from flowing through the gas head assembly 10.

Although the biasing element 110 urges the torsion ring 30 in the first direction "B", the valve core handle 45 may be used to rotate the valve core 40 and torsion ring 30 in a second direction opposite the first direction "B", e.g., counterclockwise as depicted by arrow "C". For example, an operator may apply sufficient force to the valve core handle 45 to overcome the force of the biasing element 110, such that the pin 75 abuts and pushes against the first slot end 100, thereby causing the valve core 40 and torsion ring 30 to rotate together relative to the housing 15 in the second direction "C".

The amount of force required to overcome the biasing element 110 may be set at any desired value through careful selection of the biasing element 110. In an embodiment, about 17 to 18 inch-pounds of force is required at the valve core handle 45 to overcome the biasing element 110 and cause rotation of the valve core 40 and torsion ring 30 to rotate together relative to the housing 15 in the second direction "C". However, the invention is not limited to this value, and any desired force may be set through selection of materials and geometries of the various parts.

Referring to FIG. 1, the safety mechanism 25 includes a pawl 130 that can be brought into engagement with a contact surface 117 of an indentation 120 formed in the torsion ring 30 when the valve core handle 45 is used to rotate the torsion ring 30 in the direction "C" to a predetermined position, e.g., the charged position. In an embodiment, the pawl 130 is fixedly connected to an axle 135 by, for example, a set screw 140 or other suitable fastening structure. The axle 135 is rotationally disposed within a holder 145 that is fixed to the housing 15 by a bracket 147. In this manner, the pawl 130 can be rotated toward and away from the torsion ring 30. Particularly, by way of the axle 135 and holder 145, the pawl 130 can be rotated into and out of engagement with the indentation 120 in the torsion ring 30.

Figure 3:
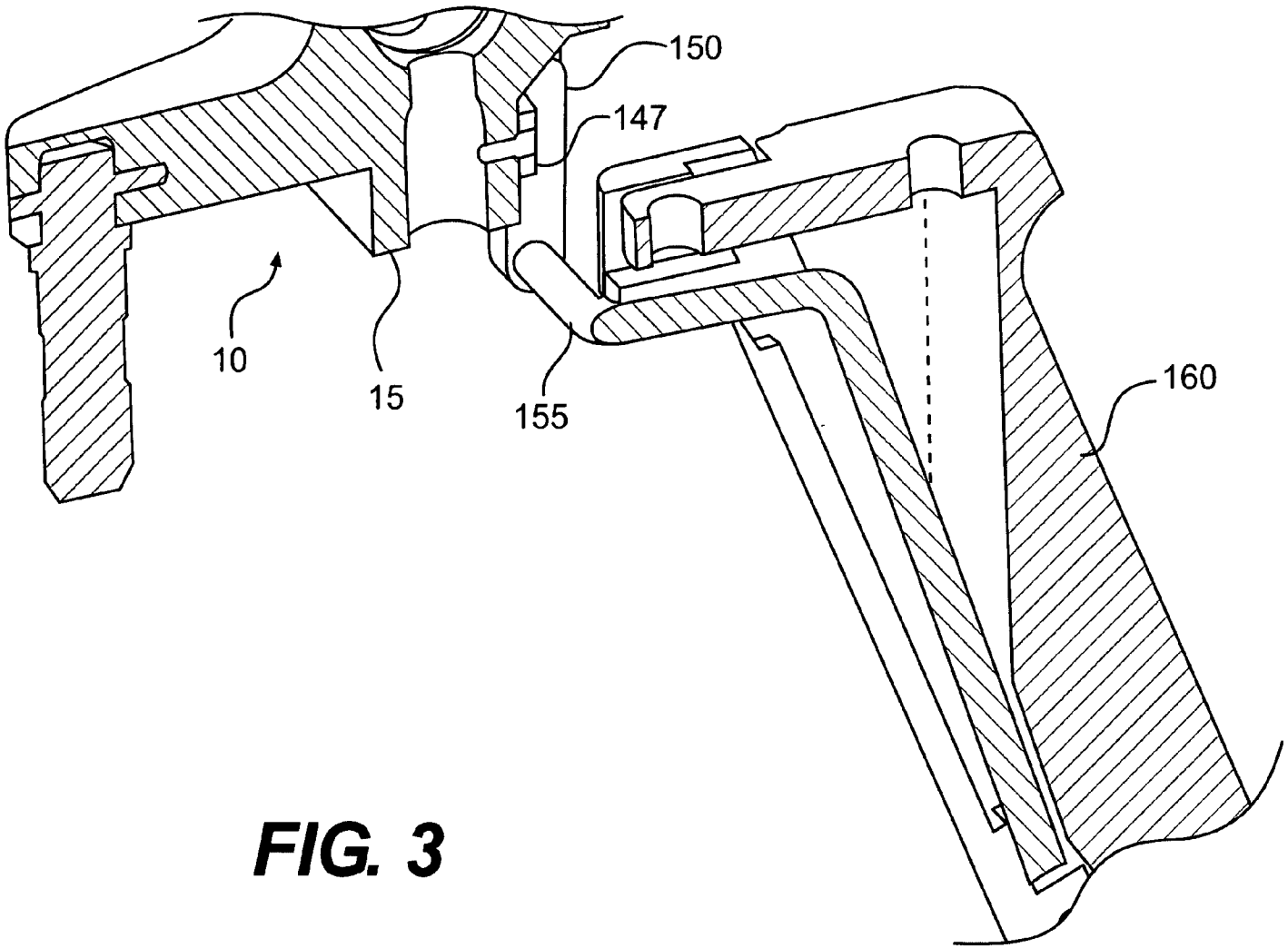

In a further embodiment, the safety mechanism 25 also includes a lever 150 fixedly attached to the axle 135 and a trigger 155 fixedly attached to the lever 150. When the gas head assembly 10 is included as part of a combustion spray gun, as partially depicted in FIG. 3, the trigger 155 may be located sufficiently close to a handle 160 of the combustion spray gun to permit an operator of the combustion spray gun to hold the handle 160 and manipulate the trigger 155 with a single hand. Although the trigger 155 is depicted in FIGS. 1 and 3 as having a cylindrical or rod shape, the invention is not limited to this shape, and any suitable shape may be used for the trigger 155.

As described above, the biasing element 110 biases the valve core 40 to an off position in which air, oxygen and fuel gas cannot flow through the gas head assembly 10. The torsion ring 30 is configured relative to the valve core 40 and the housing 15 such that the indentation 120 is located away from the pawl 130 when the valve core 40 is in the off position.

To bring the combustion spray gun into a working mode, e.g., idle or full flow, in which air, oxygen and fuel gas flow through the gas head assembly 10, an operator applies sufficient force to the valve core handle 45 in the direction "C" to overcome the biasing element 110. As described above, such a force causes rotation of both the valve core 40 and torsion ring 30 in the direction "C" relative to the housing 15. This rotation of the torsion ring 30 causes the indentation 120 to be rotated toward the pawl 130. When the indentation 120 is rotated into alignment with the pawl 130, the operator may pull the trigger 155 toward the handle 160, which causes the axle 135 to rotate within holder 145, which in turn advances the pawl 130 into engagement with the contact surface 117 of the indentation 120.

In accordance with an aspect of the invention, the safety mechanism 25 is configured such that a predetermined force applied to the trigger 155 will maintain the pawl 130 in engagement with the indentation 120, thereby holding the torsion ring 30 stationary in the charged position. Particularly, when the pawl 130 is engaged with the indentation 120, rotation of the torsion ring 30 in the direction "B" may be prevented by applying a sufficient force to the trigger 155. As described in greater detail below, when the torsion ring 30 is held fixed in the charged position by the trigger 155 and pawl 130, the valve core 40 may be rotated relative to the torsion ring 30 and housing 15 to any desired operational position of the combustion spray gun.

On the other hand, when less than the predetermined force is applied to the trigger 155, the urging force of the biasing element 110 in conjunction with the geometry of the surfaces of the indentation 120 and pawl 130 causes the torsion ring 30 to rotate and disengage the pawl 130. Therefore, when the trigger 155 is released by the operator, the biasing element 110 rotates the torsion ring 30 in the direction "B", which in turn rotates the valve core 40 to the off position. In this manner, the safety mechanism 25 operates as a deadman switch for the combustion spray gun.

The force of the biasing element 110 and the geometry of the pawl 130 and contact surface 117, among other things, will affect what amount of force at the trigger 155 is required to maintain the pawl 130 in engagement with the indentation 120. Accordingly, the predetermined force may be tailored to any desired value through selection of materials and geometries of parts. In a preferred embodiment, the predetermined force is relatively small in order to reduce operator fatigue. For example, the predetermined force may be in a range of about 1 ounce to 5 pounds, preferably in a range of about 3 ounces to 4 ounces. In a further embodiment, the contact surface 117 and a corresponding surface of the pawl 130 are arranged at an angle in a range of about 10° to 30° relative to a radial axis of the torsion ring 30, with a preferred range of about 15° to 20°, and particularly preferably at an angle of about 17°. By using surfaces arranged at this angle, the urging force of the biasing element 110 causes the contact surface 117 to push the pawl 130 out of the indentation when the trigger 155 is released. However, the invention is not limited to this geometry, and any desired geometry may be utilized within the scope of the invention.

In a particularly advantageous embodiment, the arcuate slot 95 and valve core 40 are configured such that the valve core 40 may be rotated to any desired operational position while the torsion ring 30 is held fixed in the charged position. As should be apparent from FIGS. 1 and 2 and the foregoing description, the valve core 40 is free to rotate relative to the torsion ring 30 and the housing 15 while the torsion ring 30 is held stationary by engagement of the pawl 130 and indentation 120. Particularly, the pin 75 that is connected to the valve core 40 by way of the end cap 55 is free to slide within the arcuate slot 95 while the pawl 130 prevents rotation of the torsion ring 30. Accordingly, by appropriately sizing and locating the arcuate slot 95 and the various ports within the valve core 40 and housing 15, the valve core 40 may be rotated via the valve core handle 45 to any desired operational position, e.g., off, idle/ignite, full flow, when the torsion ring 30 is held fixed by the pawl 130.

For example, when the pawl 130 is in engagement with the indentation 120, a full flow position of the valve core 40 may correspond to a position in which the pin 75 is abutting the first slot end 100, an off position of the valve core 40 may correspond to a position in which the pin 75 is abutting to the second slot end 105, and an idle/ignite position of the valve core 40 may correspond to a position in which the pin 75 is at a substantial midpoint between the first slot end 100 and second slot end 105. It is noted that the invention is not limited to these operational positions of the valve core 40. Instead, any desired number of operational positions of the valve core 40 may be defined at any desired positions of the pin 75 within the slot 95 when the pawl 130 is in engagement with the indentation 120. Additionally, one or more detent mechanisms (not shown) may be used within the housing 15 to hold the valve core 40 in the respective operational positions. Of course, when detent mechanisms are utilized, the biasing element 110 should be configured to provide sufficient rotational force to overcome the detent mechanisms when the trigger 155 is released.

In one implementation, the torsion ring 30 is made of plastic or aluminum, the pawl 130 is made of steel, for example hardened steel, and the trigger 155 is made of aluminum. Aluminum parts may be anodized. However, the invention is not limited to these materials, and the elements and parts described herein may be constructed of any suitable materials while remaining within the scope of the invention.

In another implementation, wear pads 165 are provided on at least one of the pawl 130 and the engagement surface 117 to reduce wear on these parts. The wear pads 165 may be made of hardened steel, or any other suitable material.

As described herein, the gas head assembly 10 and safety mechanism 25 may be used in combination with a hand-held, air-powered combustion spray gun. In such an implementation, the safety mechanism 25 biases the combustion spray gun to a default off state. In an exemplary method of operation, an operator may grasp the handle 160 of the combustion spray gun, in which the valve core 40 is in the default off position, and apply a force to the valve core handle 45 in the direction "C". When the force applied to the valve core handle 45 overcomes the biasing element 110, the valve core 40 and torsion ring 30 rotate relative to the housing 15 in the direction "C" until a stopping point is reached where a mechanical stop prevents further rotation of the valve core 40 and torsion ring 30 relative to the housing 15. At this point, the biasing element is "charged" and the torsion ring is in the charged position. At the charged position, the indentation 120 is substantially aligned with the pawl 130, such that the operator may move the trigger 155 in an appropriate direction and with sufficient force to bring the pawl 130 into engagement with the indentation 120.

In an embodiment, the valve core 40 is in the full flow operational position when torsion ring 30 is in the charged position and the pin 75 abuts the first slot surface 100. Thus, by rotating the valve core 40 and torsion ring 30 relative to the housing 15 in the direction "C" to the stopping point, the operator permits air, oxygen and fuel gas to flow at full flow rates through the gas head assembly 10. Full flow of the gases before ignition serves to purge the gas lines, which is beneficial for avoiding backfires.

After a sufficient amount of purge time at the full flow position, and while maintaining sufficient force on the trigger 155 to prevent rotation of the torsion ring 30, the operator rotates the valve core handle 45 in the direction "B" until the valve core 40 is located in the idle/ignite position. In the idle/ignite position, the valve core 40 permits a reduced amount of oxygen and fuel gas to flow through the gas head assembly 10. In this manner, the operator may ignite the gas mixture of the combustion spray gun in a controlled manner.

After igniting the gas mixture, and while maintaining sufficient force on the trigger 155 to prevent rotation of the torsion ring 30, the operator rotates the valve core handle 45 in the direction "C" until the valve core 40 is located again at a desired position, e.g., the full flow position. At the full flow position, the operator may use the combustion spray gun in a conventional manner to apply a coating to an object. That is to say, metal wire may be fed into the ignited gas mixture such that the metal is melted, atomized, and propelled out of a nozzle of the gun. At any time while the operator is maintaining sufficient force on the trigger 155 to prevent rotation of the torsion ring 30, the operator may move the valve core handle 45 to any desired position defined within the slot 95 in order to reposition the valve core 40 in any desired operational position, e.g., full flow, idle/start, and off.

However, should the operator release the trigger 155, such as, for example, by intentionally releasing the trigger, accidentally dropping the gun, etc., then the biasing element 110 automatically causes the valve core 40 to rotate in the direction "B" to the off position where air, oxygen and fuel gas are prevented from passing through the gas head assembly 10 and the gun is essentially shut off. In this manner, the safety mechanism 25, which includes the torsion ring 30, biasing element 110, pawl 130, and trigger 155, acts as a deadman switch for automatically shutting off a hand-held, air-powered combustion spray apparatus under certain circumstances. Beneficially, the safety mechanism 25 does not interfere with the normal operation of the combustion spray gun, but rather, once engaged, permits the combustion spray gun to operate at any desired operational state.

Figure 4A:
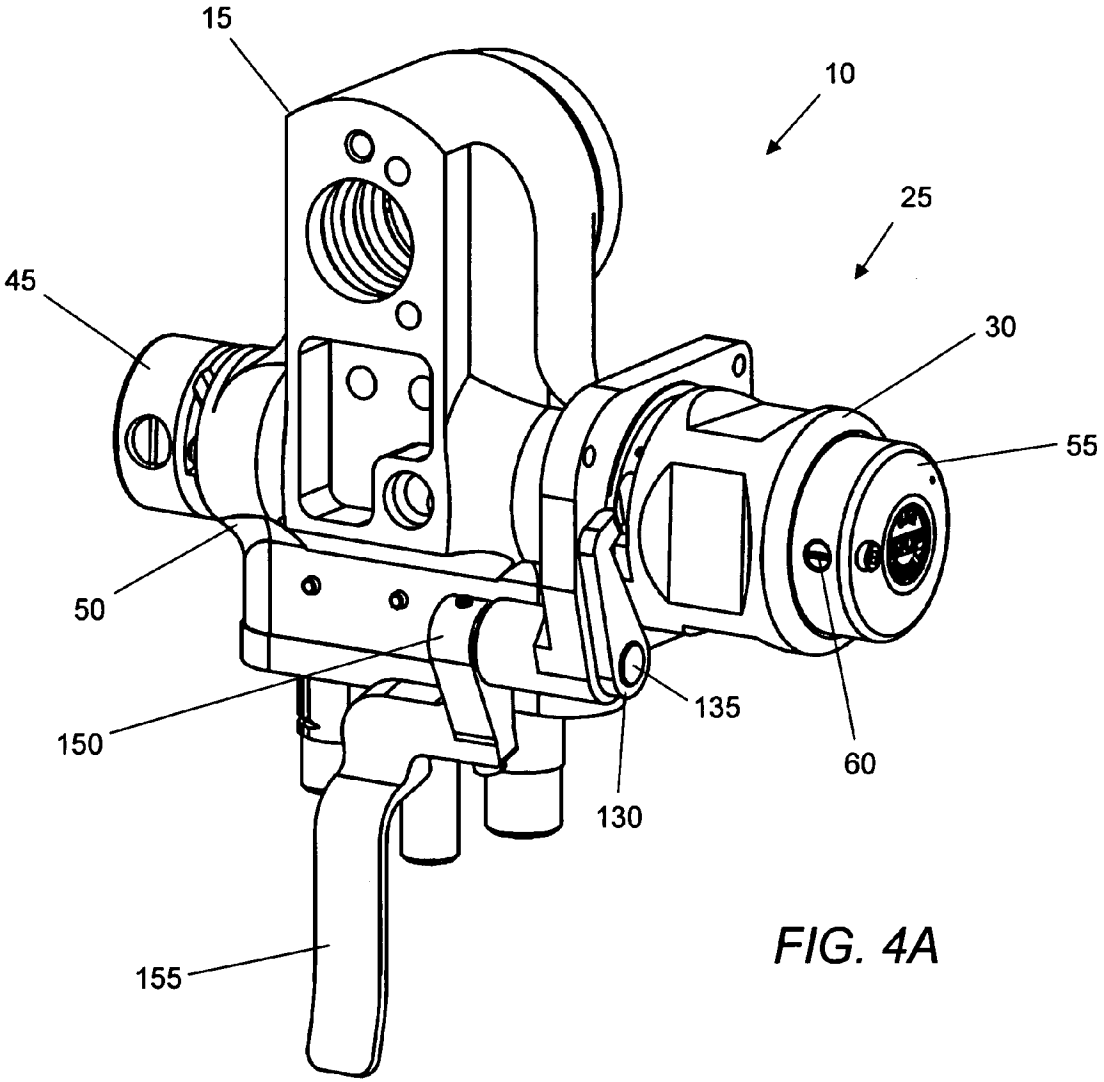
Figure 4B:
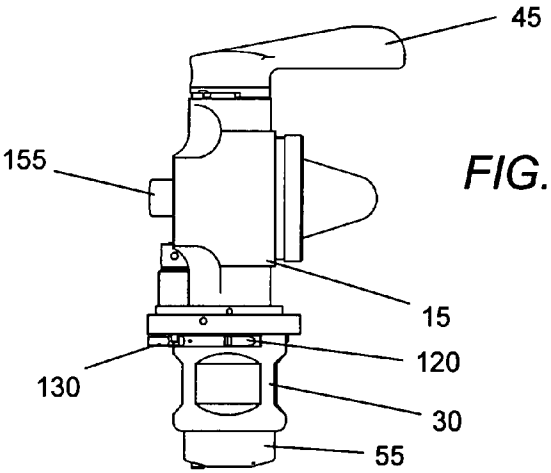
Figure 4F:
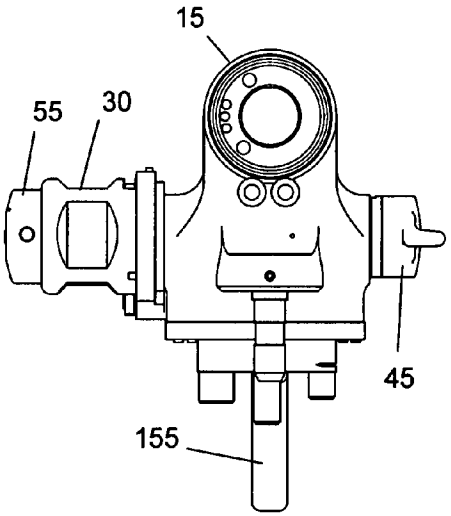
Figure 4E:
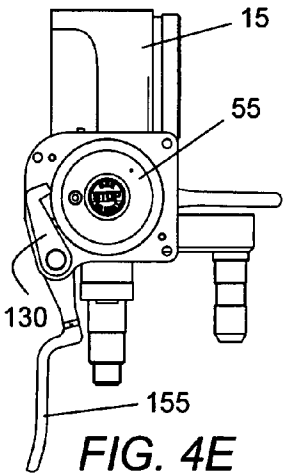
Figure 4D:
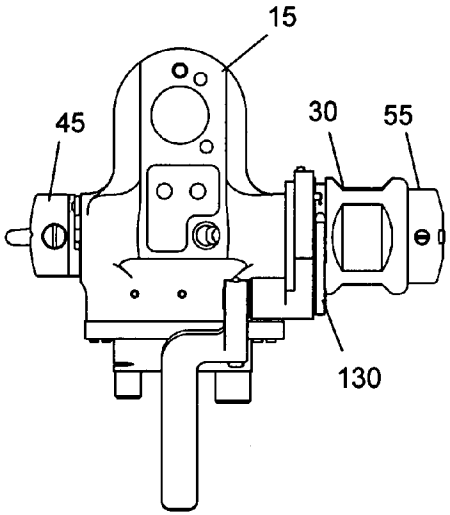
Figure 4C:
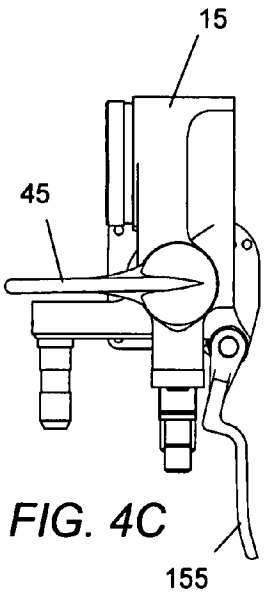

FIGS. 4A-4F, 5A-5F, and 6A-6F show various views of another embodiment of the invention, in which like reference numerals represent elements already described herein. More specifically, FIGS. 4A-4F show a gas head assembly 10 having a housing 15 and a valve core handle 45. A safety mechanism 25 in accordance with an aspect of the invention includes a torsion ring 30, pawl 130, axle 135, lever 150, and trigger 155. As depicted in FIGS. 4A and 4E, the pawl 130 is disengaged from the torsion ring 30. Accordingly, the valve core (not visible in FIGS. 4A-4F) is depicted as being in the default off position by virtue of the torsion ring 30, end cap 55, and screw 60.

Figure 5A:
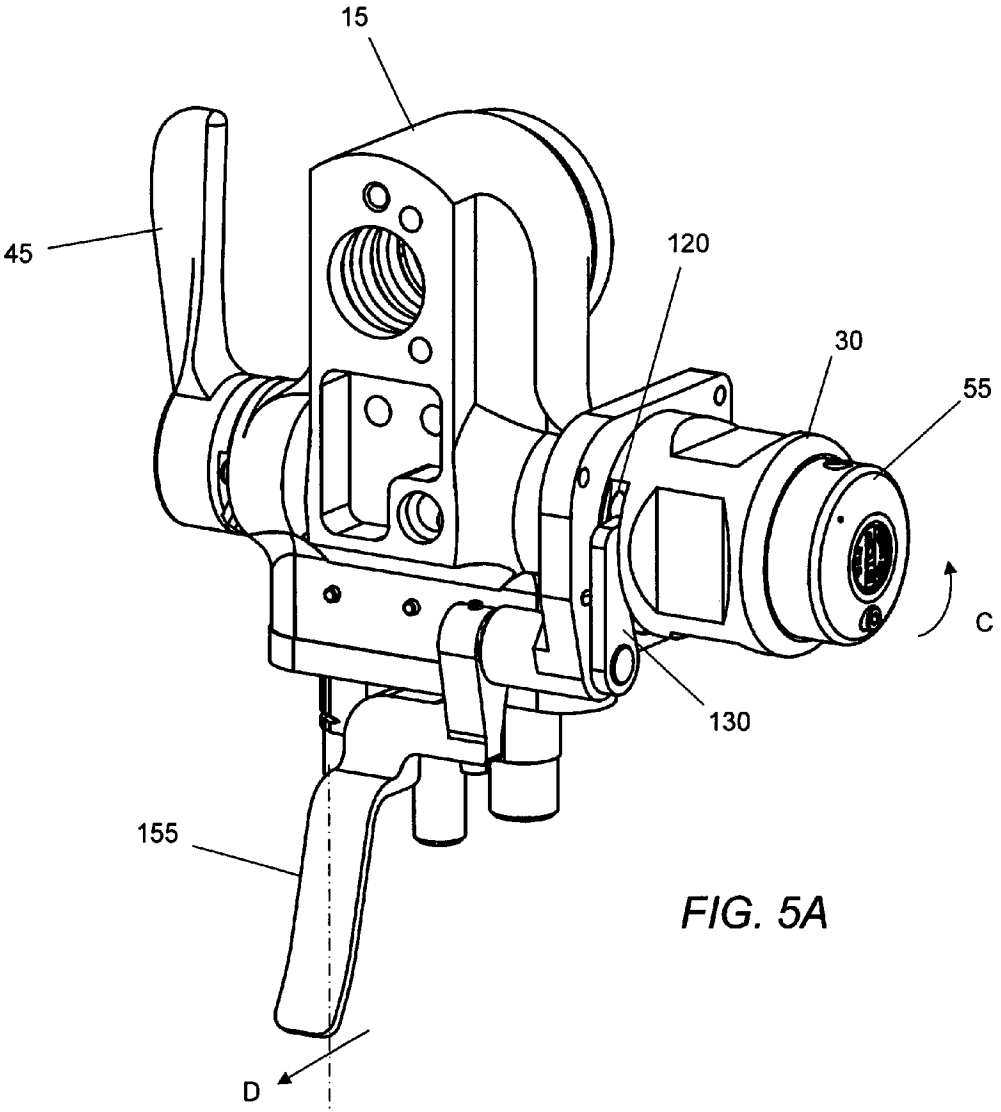
Figure 5B:
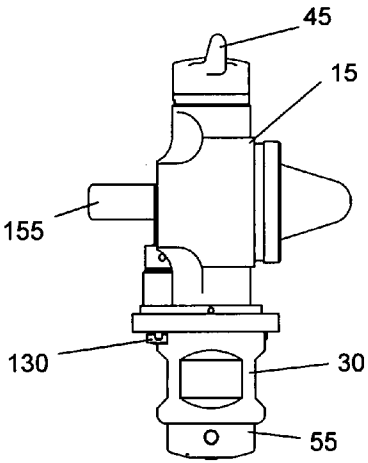
Figure 5F:
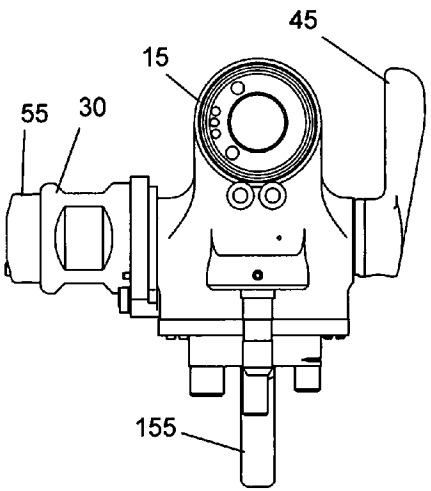
Figure 5E:
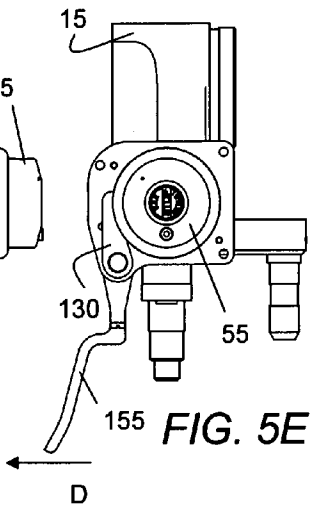
Figure 5D:
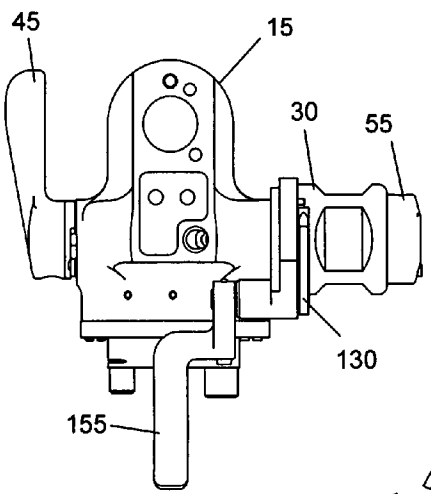
Figure 5C:
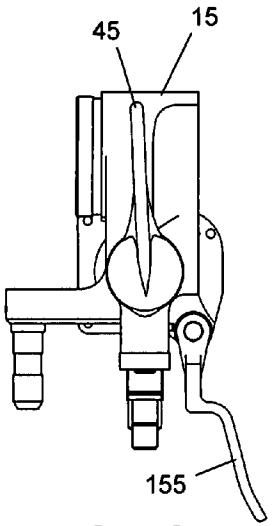
Figure 6A:
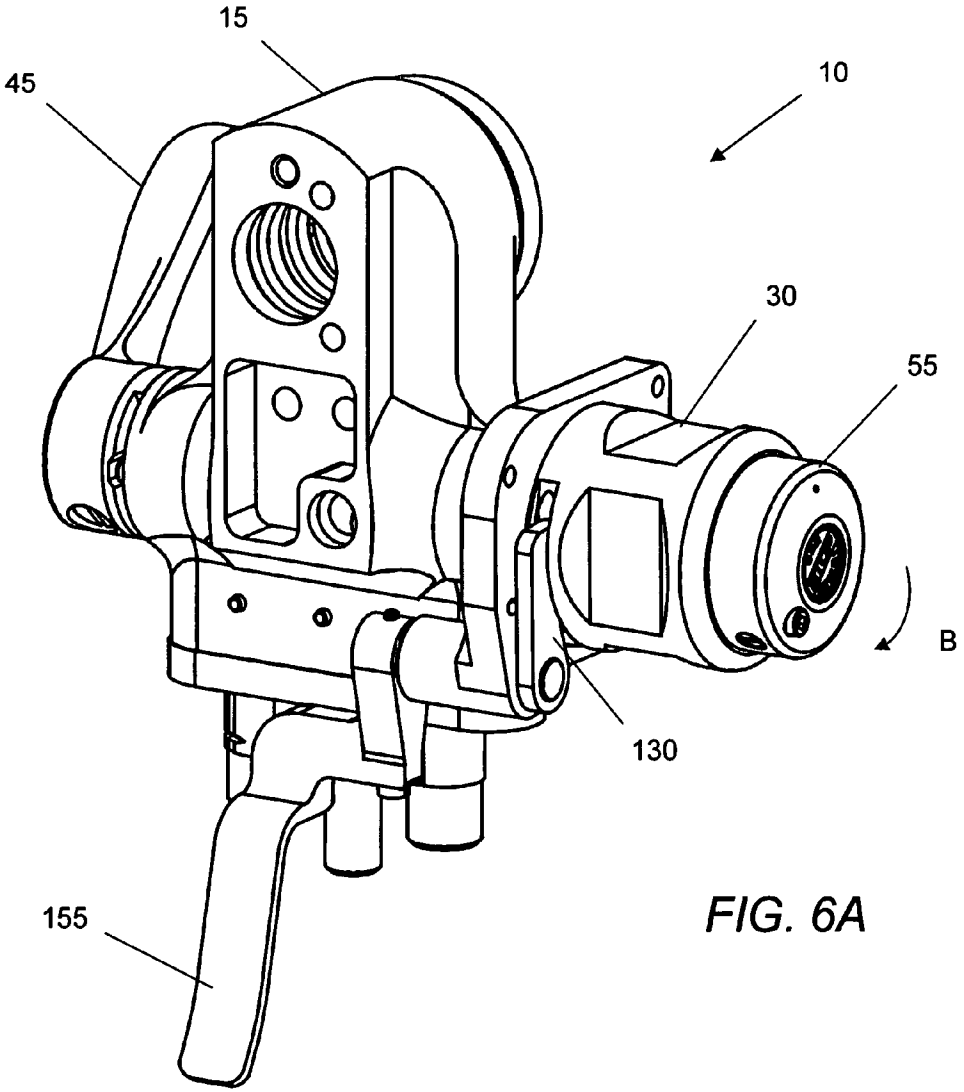
Figures 6B, 6C, 6D, 6E, 6F:
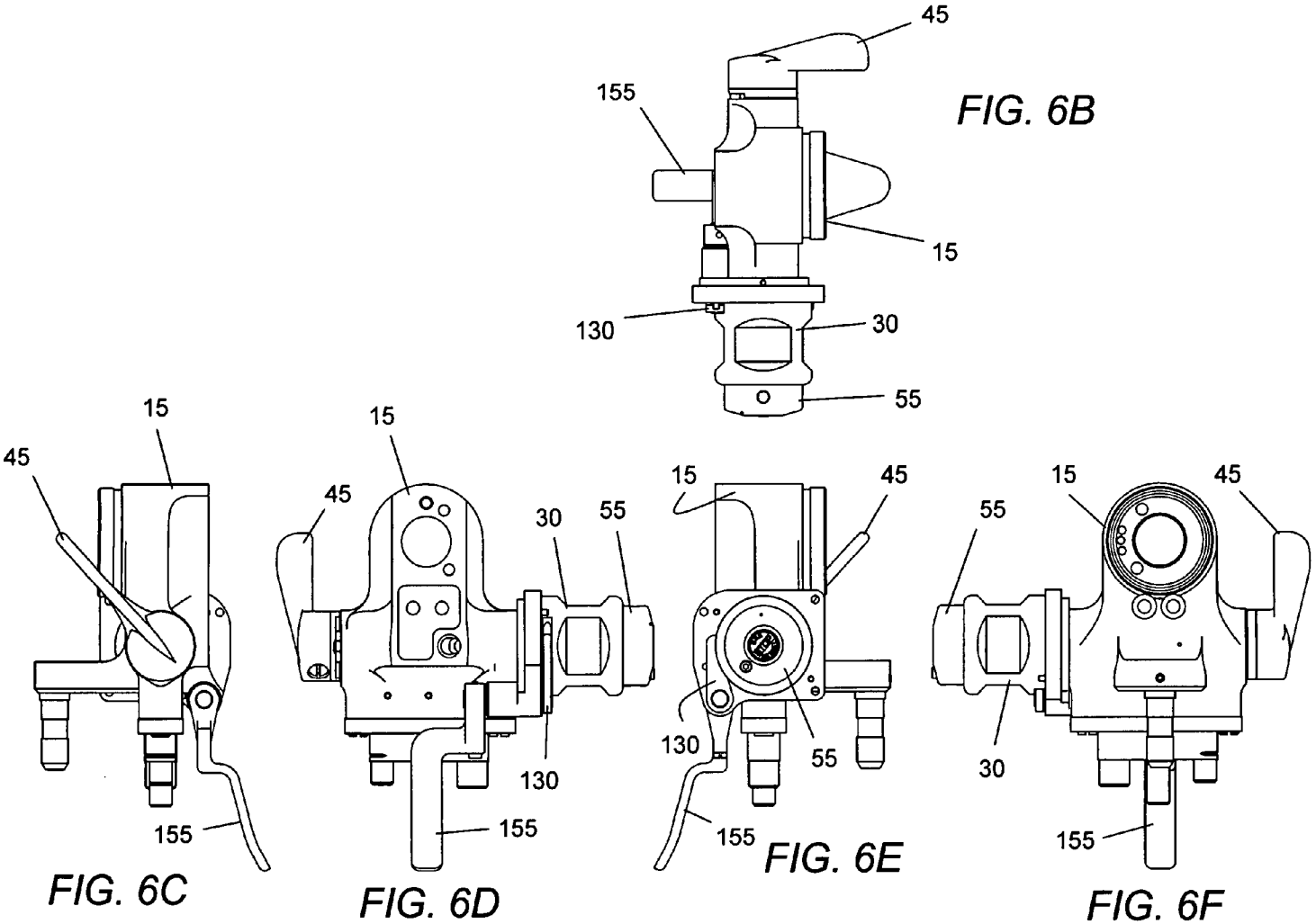

FIGS. 5A-5F depict the apparatus where the valve core handle 45, and consequently the valve core and end cap 55 are arranged at the full flow position. Also in FIGS. 5A-5F, the torsion ring 30 is shown in the charged position where the indentation 120 is aligned with the pawl 130. Additionally, FIGS. 5A and 5E depict where the trigger 155 has been moved in the direction "D", which has caused the pawl 130 to come into engagement with the indentation 120 of the torsion ring 30.

The state shown in FIGS. 5A-5F may correspond to, for example, the situation where an operator has rotated the valve core handle 45 from the default off position to move the torsion ring 30 into the charged position, and then grasped the trigger 155 to bring the pawl 130 into engagement with the indentation 120. The torsion ring 30 will remain fixed relative to the housing 15 so long as the operator maintains sufficient force on the trigger 155. While the torsion ring 30 is held stationary relative to the housing, the operator may move the valve core handle 45 to any desired position within the confines of the arcuate slot (not shown). However, should the operator release the trigger, then the biasing element will rotate the torsion ring 30 relative to the housing 15, which will force the valve core 40 to the off position.

FIGS. 6A-6F depict the apparatus where the torsion ring 30 is held in the charged position by the pawl 130 and the trigger 155, while the valve core handle 45 is arranged in the idle/start position. As described above with respect to FIGS. 1-3, the valve core handle 45 is free to rotate in either direction "B" or direction "C" when the torsion ring 30 is held fixed in the charged position by the pawl 130 and trigger 155. However, when the trigger 155 is released, the biasing element (not visible in FIGS. 4-6) urges the torsion ring 30, and consequently the valve core, to the off position.

FIGS. 7-12 depict different views of an embodiment of the invention in which like reference numerals represent elements already described herein. More specifically, FIGS. 7-12 show various views of a gas head assembly 10 including a housing 15, valve core 40, and valve core handle 45. The apparatus also has a safety mechanism 25 that includes a torsion ring 30, biasing element 110, pawl 130, axle 135, lever 150, and trigger 155. An end cap 55 is attached to the valve core 40 via a screw 60, and a slot 95 defines a range of relative rotational movement between the torsion ring 30 and the valve core 40.

Also depicted in FIGS. 7-12 is an optional cover 200. In an embodiment, the cover 200 includes a first portion 202 that covers and protects the torsion ring 30 and end cap 55. The first portion 202 may be substantially cylindrical, although the invention is not limited to this shape and any desired shape may be used. In a further embodiment, the cover 200 includes a second portion 203 that at least partially covers and protects the pawl 130. The first portion 202 and second portion 203 may be integral, or may be removably connected to each other. In a particular embodiment, the cover 200 is removably connected to the housing 15 by at least one mechanical fastener, such as, but not limited to, at least one screw 204.

Additionally shown in FIGS. 7-12 are inlet ports 205, 210, and 215 where oxygen, fuel gas, and compressed air may be input into the gas head assembly 10. Also shown are numerous internal ports 220*a*, 220*b*, 200*c*, etc., in the valve core 40 and numerous internal ports 230*a*, 230*b*, etc., in the housing 15 for routing oxygen, fuel gas, and compressed air through the gas head assembly 10. In one embodiment, the housing 15 includes a flange 240 or other mounting structure for connecting an air cap of the combustion spray gun.

Figure 13:
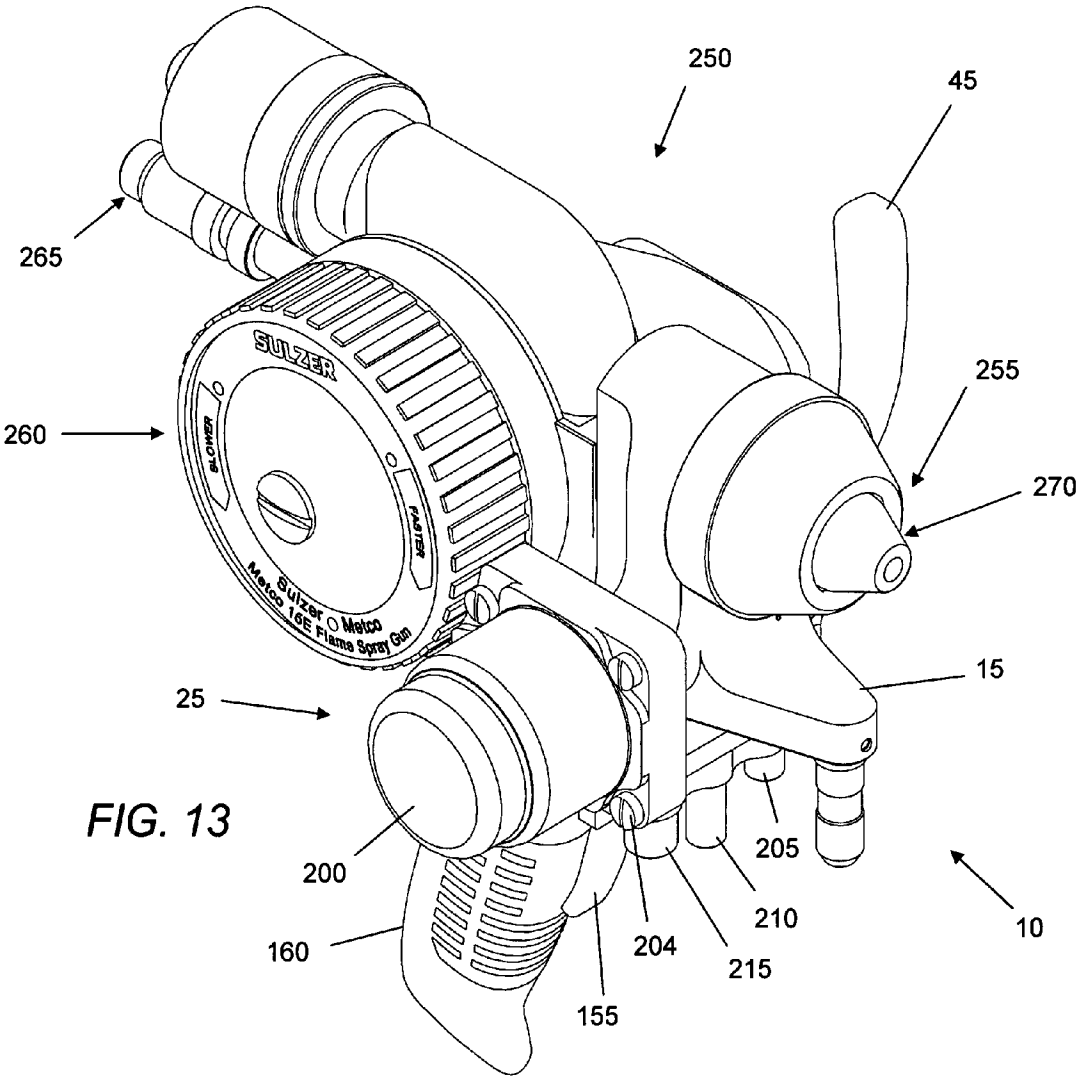
FIG. 13 shows a combustion spray gun equipped with a safety mechanism in accordance with aspects of the invention.

FIG. 13 shows a combustion spray gun 250 in accordance with aspects of the invention. In an embodiment, the combustion spray gun 250 includes a gas head assembly 10 and safety mechanism 25 as described herein. For example, the gas head assembly 10 includes a housing 15 having inlets 205, 210, 215 for oxygen, fuel gas, and process air. Portions of the safety mechanism 25 are contained within the cover 200, which is removably connected to the housing 15 by screws 204. Valve core handle 45 extends from one side of the housing 15 for adjusting the position of the valve core.

In an embodiment, the combustion spray gun 250 includes a handle 160. The trigger 155 extends near the handle 160 such that an operator can manipulate the trigger 155 while holding the combustion spray gun 250 via the handle 160. The combustion spray gun 250 may also include an air cap 255 that functions to mix the oxygen and fuel gas.

In a further embodiment, the combustion spray gun 250 includes an air turbine 260 that is powered by the compressed air. The air turbine 260 drives an internal wire drive roll, via a reduction gearing system, to draw a metal wire into the wire inlet 265 and move the metal wire into the air cap 255 where the metal is melted, atomized, and entrained in the flow of gasses exiting the outlet nozzle 270.

Figure 16:
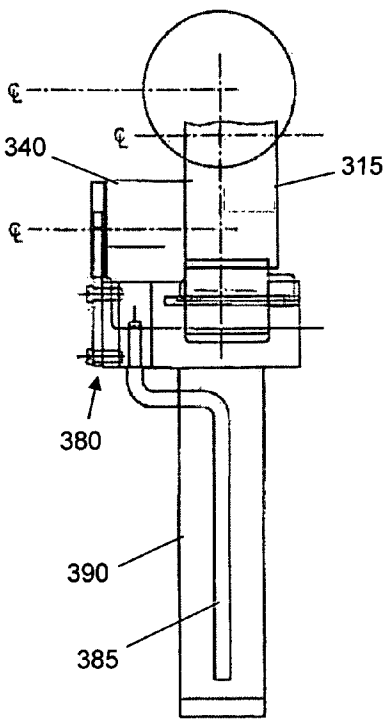
FIGS. 14-16 show aspects of an alternate embodiment of a safety mechanism for use with a combustion spray gun in accordance with aspects of the invention.
Figure 15:
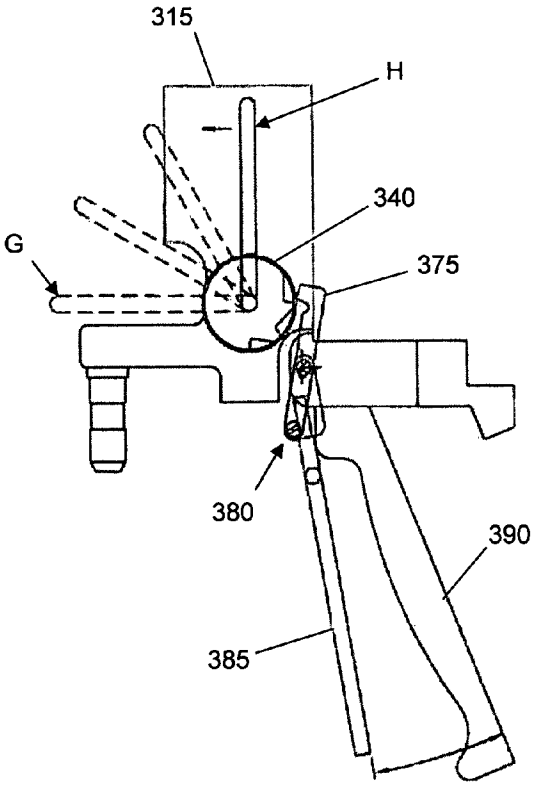
Figure 14:
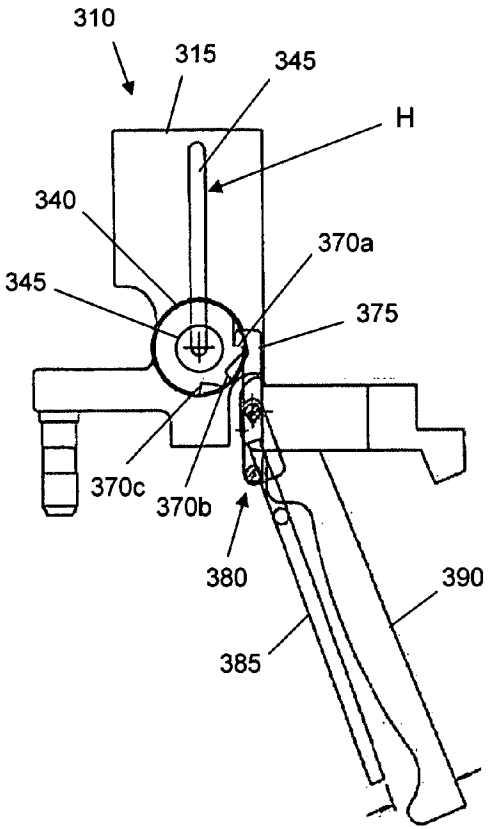

FIGS. 14-16 show views of another embodiment of a safety mechanism for a hand-held combustion spray gun according to an implementation of the invention. More specifically, FIGS. 14-16 depict a gas head assembly 310 having a housing 315 and valve core handle 345, which may be similar to gas head assembly 10, housing 15 and valve core handle 45 described with respect to FIG. 1. The gas head assembly 310 may also include a valve core 340 that operates to control flow of oxygen, fuel gas, and compressed air using ports and rotational positions, similar to the valve core 40 described with respect to FIG. 1.

In contrast to the embodiment shown in FIG. 1, the valve core 340 includes a plurality of engagement surfaces 370*a*, 370*b*, 370*c* that are selectively engagable with a pawl 375 attached to a trigger 385 by a linkage 380. In a particular embodiment, each respective engagement surface 370*a*, 370*b*, 370*c* corresponds to a predetermined operational position of the valve core 340. Additionally, a biasing element 365 is connected between the valve core 340 and the housing 315 to urge the valve core 340 toward the off position, e.g., represented by valve core handle 345 position "G". The biasing element 365 may be, for example, a torsion spring similar to that described above with respect to FIGS. 1 and 2. However, there is no torsion ring in the embodiment shown in FIGS. 14-16. Instead, the biasing element 365 acts directly on the valve core 340 to urge the valve core to rotate relative to the housing at all times. Alternatively, a torsion ring that is fixed to the valve core 340 may be used, where the biasing element 365 is arranged between the torsion ring and the housing 315 and there is no relative movement between the torsion ring and the valve core 340.

In using the apparatus shown in FIGS. 14-16, an operator holds the combustion spray gun by the handle 390 and moves the valve core handle 345 to any desired position, such as, for example, the full flow position "H". When the valve core handle 345 is set in a predetermined operational position, the operator grasps the trigger 385 to bring the pawl 375 into engagement with a respective one of the engagement surfaces 370*a*, 370*b*, 370*c* that corresponds to the selected operational position of the valve core 340 and valve core handle 345.

To move the valve core 340 between operational positions, the operator grasps the valve core handle 345, releases the trigger 385, rotates the valve core handle 345 to the new position, and then grasps the trigger again to bring the pawl 375 into engagement with another one of the engagement surfaces 370*a*, 370*b*, 370*c*. If the operator releases the trigger for whatever reason without simultaneously controlling the valve core handle 345, then the biasing element 365 causes the valve core 340 to automatically rotate to the off position. In this manner, the apparatus depicted in FIGS. 14-16 provides a deadman switch with reduced weight and bulk, e.g., by eliminating elements such as the torsion ring, end cap, etc.

Figure 17:
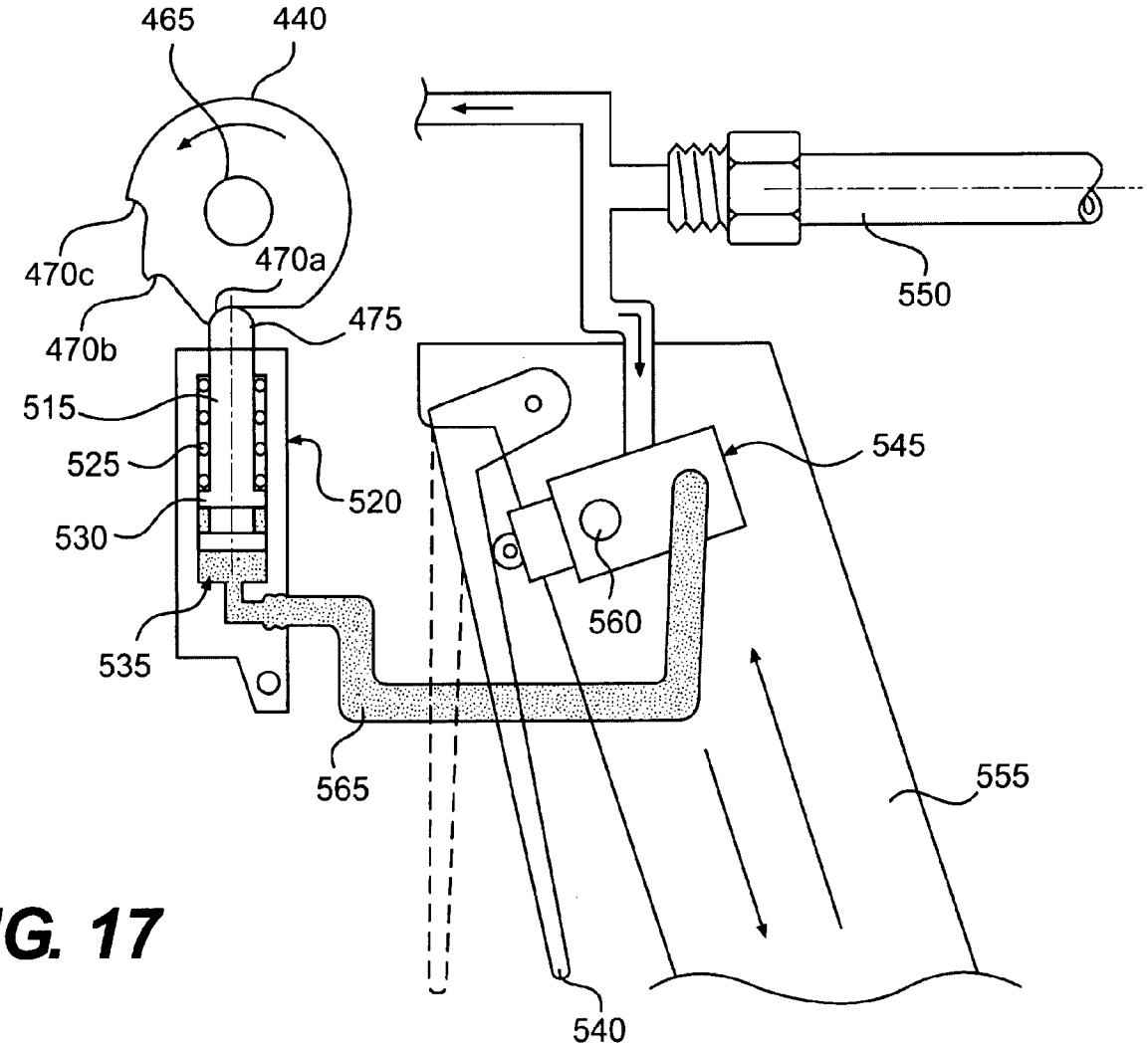
FIG. 17 shows aspects of an alternate embodiment of a safety mechanism for use with a combustion spray gun in accordance with aspects of the invention.

FIG. 17 depicts another embodiment of a safety mechanism for a hand-held combustion spray gun according to an implementation of the invention. Alternatively to a mechanically driven pawl, such as those described above with respect to FIGS. 1-16, the pawl may be pneumatically or electrically driven. More specifically, FIG. 17 shows a safety mechanism having a pneumatically driven pawl 475 that is moveable into and out of engagement with engagement surfaces 470*a*, 470*b*, 470*c* of a valve core 440. The valve core 440 may be similar to valve core 340 described above with respect to FIGS. 14-16 in that it operates to control flow of oxygen, fuel gas, and compressed air using ports and rotational positions, and includes a plurality of respective engagement surfaces 470*a*, 470*b*, 470*c* that correspond to predetermined operational positions. Additionally, the valve core 440 may be rotatably held in a housing of a gas head assembly of a combustion spray gun similar to that described above with respect to FIG. 1.

In an embodiment, a biasing element 465 is connected between the valve core 440 and the housing to urge the valve core 440 toward the off position. The biasing element 465 may be, for example, a torsion spring similar to that described above with respect to FIGS. 1 and 2. However, there is no torsion ring in the embodiment shown in FIG. 17. Instead, the biasing element 465 acts directly on the valve core 440 to urge the valve core 440 to rotate relative to the housing at all times. Alternatively, a torsion ring that is fixed to the valve core 440 may be used, where the biasing element is arranged between the torsion ring and the housing and there is no relative movement between the torsion ring and the valve core 440.

In the implementation shown in FIG. 17, the pawl 475 is brought into and out of engagement with the engagement surfaces 470*a*, 470*b*, 470*c* by way of a pneumatic assembly. More specifically, the pawl 475 is formed as part of a piston 515 that is slidably retained in a cylinder 520. A spring 525 inside the cylinder 520 acts on a head 530 of the piston 515 to urge the piston 515 away from the valve core 440, e.g., to urge the pawl 475 out of engagement with any of the surfaces 470*a*, 470*b*, 470*c*.

The piston 515 may be moved against the force of the spring 525, e.g., to move the pawl 475 toward the valve core 440, by providing sufficient pressure in a chamber 535 of the cylinder 520 on a side of the head 530 located opposite the spring 525. More specifically, when the pressure in the chamber 535 acting on the surface area of the head 530 exceeds the force of the spring 525, the piston 515 is extended out of the cylinder 520 such that the pawl 475 is driven toward the valve core 440. Alternatively, when the pressure in the chamber 535 acting on the surface area of the head 530 does not exceed the force of the spring 525, the piston 515 is retracted into the cylinder 520 such that the pawl 475 is pulled away from the valve core 440.

Pneumatic pressure is selectively provided to the chamber 535 via a trigger 540 and switch 545 that are operatively connected between a compressed air source 550 of the combustion spray gun and the cylinder 520. More specifically, the trigger 540 moves the switch 545 into a first state when the trigger 540 is depressed toward the handle 555. The switch 545 is configured such that, in the first state, a vent 560 is closed and the compressed air source 550 is placed in communication with a conduit 565. Accordingly, when the switch 545 is in the first position, compressed air flows from the compressed air source 550, through a conduit 565, and into the chamber 535, thereby overcoming the force of the spring 525 and moving the pawl 475 toward the valve core 440. Thus, when the trigger 540 is depressed toward the handle 555, the pawl 475 is extended toward the valve core 440.

On the other hand, the trigger 540 places the switch 545 in a second state when the trigger 540 is moved away from the handle 555, such as for example, if the combustion spray gun is accidentally dropped. In the second state, the vent 560 is open to atmosphere and the compressed air source 550 is blocked, e.g., taken out of communication with the conduit 565. In this manner, air from the chamber 535 and conduit 565 is permitted to bleed out of the vent 560. Accordingly, the force of the spring 525 retracts the piston 515 into the cylinder 520, thereby pulling the pawl 475 out of engagement with the valve core 440.

In using the apparatus shown in FIG. 17, an operator holds the combustion spray gun by the handle 555 and moves the valve core handle to any desired position, such as, for example, the full flow position where engagement surface 470*a* aligns with the pawl 475. When the valve core handle is set in the desired operational position, the operator pulls the trigger 540 toward the handle 555. This brings the pawl 475 into engagement with the respective one of the engagement surfaces 470*a*, 470*b*, 470*c* that corresponds to the selected operational position of the valve core 440 and valve core handle.

To move the valve core 440 between operational positions, the operator grasps the valve core handle, releases the trigger 540, rotates the valve core handle to the new position, and then grasps the trigger again to bring the pawl 475 into engagement with another one of the engagement surfaces 470*a*, 470*b*, 470*c*. If the operator releases the trigger 540 for whatever reason without simultaneously controlling the valve core handle, then the pawl 475 will move out of engagement with the valve core 440, and the biasing element 465 will cause the valve core 440 to automatically rotate to the off position. In this manner, the apparatus depicted in FIG. 17 provides a deadman switch that is pneumatically operated.

In another embodiment, the pneumatically operated pawl 475 depicted in FIG. 17 can be used with the safety mechanism depicted in FIGS. 1 and 2. For example, the trigger 540, valve 545, piston 515, cylinder 520, spring 525, conduit 565, and air source 550 could be used to selectively move the pawl 475 into engagement with the indentation 120 of the torsion ring 30, instead of using trigger 155 and pawl 130. Alternatively, the trigger 540, valve 545, piston 515, cylinder 520, spring 525, conduit 565, and air source 550 could be positioned to selectively apply a force to the pawl 130 to selectively move the pawl 475 into engagement with the indentation 120 of the torsion ring 30.

A solenoid or other electrical actuator could be used instead of the pneumatic arrangement shown in FIG. 17. For example, depression of a trigger may energize a solenoid to a first position that moves a pawl into engagement with an engagement surface of a valve core or torsion ring, while releasing the trigger energizes the solenoid to a second position that moves the pawl out of engagement with the valve core or torsion ring.

Additionally or alternatively, an emergency stop button may be provided that is electrically connected to the solenoid, but that is remotely located with respect to the hand-held combustion spray gun. In an embodiment, depressing the emergency stop button energizes the solenoid to the second position. In this manner, a person who is far away from the combustion spray gun may turn off the combustion spray gun by depressing the emergency stop button.

Additionally or alternatively, a computerized controller may be provided that is electrically connected to the solenoid, but that is remotely located with respect to the hand-held combustion spray gun. For example, the computerized controller may be provided with sensors that detect operational parameters of the combustion spray gun. When a predefined condition is detected, the computerized controller may energize the solenoid to the second position to disengage the pawl from the valve core and permit the torsion spring to automatically rotate the valve core to the off position.

The safety mechanisms described herein can be added or retrofitted to existing hand-held, gas-powered devices that use rotary valve cores. More specifically, the safety mechanisms described herein may be added externally without modification of the interior ports and gas passageways of the valve core and/or housing.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus configured to provide a safety mechanism for a combustion spray gun, comprising:

a torsion element rotatable relative to a housing of the combustion spray gun to a charged position;

a biasing element applying a force to the torsion element, which force urges the torsion element to move a valve core to an off position; and an engagement mechanism configured to selectively engage and hold the torsion element in the charged position, wherein:

the torsion element comprises an engagement surface, and the engagement mechanism comprises a pawl structured and arranged to engage the engagement surface, and wherein the engagement surface is formed in an indentation at an outer portion of the torsion element.

2. The apparatus of claim 1, wherein:

the engagement mechanism holds the torsion element in the charged position when at least a predetermined force is applied to the engagement mechanism, and the engagement mechanism disengages from the torsion element when less than the predetermined force is applied to the engagement mechanism.

3. The apparatus of claim 1, wherein the valve core is rotatable relative to the torsion element and the housing while the torsion element is held in the charged position by the engagement mechanism.

4. The apparatus of claim 1, wherein the biasing element comprises a spring that biases the torsion element to rotate relative to the housing.

5. The apparatus of claim 1, wherein the combustion spray gun is a hand-held, air powered combustion spray gun.

6. A apparatus configured to provide a safety mechanism for a combustion spray gun, comprising:

a torsion element rotatable relative to a housing of the combustion spray gun to a charged position;

a biasing element applying a force to the torsion element, which force urges the torsion element to move a valve core to an off position;

an engagement mechanism configured to selectively engage and hold the torsion element in the charged position, wherein:

the torsion element comprises an engagement surface, and the engagement mechanism comprises a pawl structured and arranged to engage the engagement surface; and a trigger fixedly connected to the pawl, wherein the trigger is structured to move the pawl relative to the torsion element.

7. The apparatus of claim 6, wherein application of a trigger force to the trigger that is greater than or equal to a predetermined force maintains the pawl in engagement with the engagement surface and prevents the biasing element from rotating the torsion element.

8. A method of operating a combustion spray gun, comprising:

charging a torsion element into a charged position;

releasably grasping a trigger to selectively maintain the torsion element in the charged position;

adjusting a gas flow to a nozzle while the torsion element is selectively maintained in the charged position; and cutting the gas flow to the nozzle when the trigger is released, wherein:

the charging of the torsion element comprises rotating a valve core from an off position to a flow position against a force of a biasing element, and the cutting the gas flow comprises the torsion element moving the valve core to an off position under the force of the biasing element.

9. The method of claim 8, further comprising igniting the gas flow.

10. The method of claim 9, further comprising feeding a metal wire into the ignited gas flow.

11. A method of operating a combustion spray gun, comprising:

charging a torsion element into a charged position;

releasably grasping a trigger to selectively maintain the torsion element in the charged position;

adjusting a as flow to a nozzle while the torsion element is selectively maintained in the charged position; and cutting the gas flow to the nozzle when the trigger is released, wherein the releasably grasping of the trigger inserts a pawl into a notch formed in the torsion element.

* * * * *